US005110306A

United States Patent [19]

Buck et al.

[11] Patent Number: 5,110,306

[45] Date of Patent: May 5, 1992

[54] COMPACT CONNECTOR ASSEMBLY AND TERMINATION GUIDE THEREFOR

[75] Inventors: Steven K. Buck, Buda; Wendall D. Willey, Austin, both of Tex.

[73] Assignee: W. L. Gore & Associates, Inc., Newark, Del.

[21] Appl. No.: 735,216

[22] Filed: Jul. 24, 1991

[51] Int. Cl.[5] ..... H01R 13/00

[52] U.S. Cl. ..... 439/497

[58] Field of Search ..... 439/492–499, 439/607–610

[56] References Cited

U.S. PATENT DOCUMENTS

| | | | |
|---|---|---|---|
| 4,094,564 | 6/1978 | Cacolici | 439/497 |
| 4,381,129 | 4/1983 | Krenz | 439/497 |
| 4,639,053 | 1/1987 | Reichardt et al. | 439/497 |

*Primary Examiner*—Joseph H. McGlynn

[57] ABSTRACT

A compact connector assembly and insulative termination guide for termination of very small conductors and cables with retention of good strain relief, load sharing between conductors, minimum wire manipulation stress and damage, reliable connection, separation, and insulation of conductors and shielding, and superior electrical performance.

20 Claims, 5 Drawing Sheets

COMPACT CONNECTOR ASSEMBLY AND TERMINATION GUIDE THEREFOR

FIELD OF THE INVENTION

The invention relates to connectors and assemblies for terminating signal wires, pairs, ribbon cables, round cables and coaxial cables to multi-row connectors having connector pins set in very close spacing arrangements.

BACKGROUND OF THE INVENTION

There is a continuing need for smaller and lighter weight, insulated signal conductors terminated to increasingly small and lightweight connectors and assemblies as electronic signal and computer equipment utilizing them also becomes increasingly small and compact. Termination of such small wires and cables to connectors to give high quality and reliable connections can be quite tedious and difficult owing to severe problems of working space, bending stress of conductors and connector parts owing to over-handling, achieving sufficient strain relief of the conductors and cables, maintenance of electrical isolation of conductive parts and conductors, and alignment problems of very tiny pin and apertures.

SUMMARY OF THE INVENTION

The invention comprises a miniature connector assembly of a flat ribbon coaxial cable with a very small size connector having very closely spaced pins, such as on 0.025 inch centers, for example, and a shaped polytetrafluoroethylene (PTFE) guide to facilitate assembly, reliability, and use of smaller connector parts, such as the connector body and backshell. Such a connector and guide enables easy termination and assembly of miniature ribbon coaxial cable to a dual row connector having a 0.025 inch center spaced pin arrangement, for instance, in which the pins are connected via a lead frame individually to the conductors and shields while the pins remain within their apertures within the body of the connector. Electrical isolation of conductive wires, shields, and connector components is readily maintained by means of the guide and the provision of strain relief of the wires of the cable and the connector parts is greatly simplified. A shorter and smaller connector backshell is therefore usable on the connector. Some advantages of the invention are negated in larger size assemblies, but those of load sharing, strain relief, and compact backshell remain.

The shaped PTFE assembly guide is cut to shape from preferably solid PTFE stock or other suitable polymer insulation sheeting by a machining means, laser cutting, injection molding, or other method which allows accurate dimensions to be achieved on very tiny parts. Other methods of cutting, shaping, and molding may be used where they are effective for manufacture of very small accurately shaped articles. Other materials than PTFE may be used, such as ceramic or polyphenylene sulfide.

The guide of the invention is an elongated bar of PTFE having a long slot cut through the center of the bar of a size that the cable or wires being terminated pass through the back of the slot to the forward face of the slot. The top and/or bottom sides of the bar each bear a row of grooves and alternating spacers which extend across the width of the bar surface to about the same width as the slot. The termination of a ribbon cable to the pins of a connector body is begun by stripping the jacket from the cable to expose the cable shielding. The shielding is peeled carefully from each coaxial cable in the ribbon cable, rolled into a narrow wire-like roll, and the rolled shielding folded either upwardly or downwardly into an appropriate groove cut into the top or bottom of the guide. The insulation is then stripped from the center conductors of the cable to expose the signal conductors, which are folded about the end of the guide into grooves cut into the guide on the face opposite the grooves into which have been folded the rolls of shielding. The connector is prepared for assembly by crimping individual pins or sockets onto lead frames, which are conveniently made by a photo etching process or by stamping, laser cutting, or water knife. The leads of the frames are on 0.025 inch centers. The pins are then inserted into the connector with the lead frames extending out the back of the connector. The guide is then inserted between the lead frames extending from the body of the connector. The lead frames now lie parallel to the cable center conductors and shielding rows in the grooves of the guide. The lead frames and shielding rolls are now easily soldered or crimped to the lead frames lying adjacent to them in each groove. Solder preforms may be incorporated into the grooves to facilitate easy soldering or crimp barrels may be incorporated into the lead frames for easy crimping to the center conductors and shielding rolls. The excess conductors, shields, and the back portion of the lead frames are then clipped off. Liquid curable, hardenable insulative polymer material, such as liquid epoxy polymer, is now filled into the spaces around the back face of the connector body, the lead frame, and the guide, after the backshell has been pushed over the lead frame and guide to mate with the connector body. The backshell and body are held together until the liquid polymer fill has sufficiently cured and hardened to hold the components together in an assembly of cable, guide, backshell, body, and insulative polymer fill which has good cable strain relief properties and is ready for use.

The guide component of the invention provides a mechanism for aligning, capturing, and retaining cables particularly in very small connectors which form together a high performance connector assembly.

DETAILED DESCRIPTION OF THE INVENTION

The assembly and guide of the invention are now described in detail with reference to the figures in order to more carefully delineate the invention.

The assembly and guide of the invention can be used to terminate a miniature multi-position ribbon coaxial cable into a multi-pin multi-row connector of very close pin center spacing, for example, an 8-position 40-gauge conductor cable into a 15-position connector on 0.025 inch pin spacing.

Figure 1:
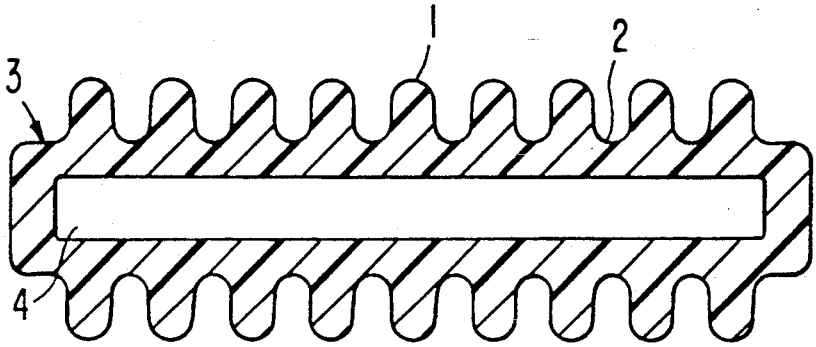
FIG. 1 describes in a cross-sectional view a guide of the invention.
Figure 5:
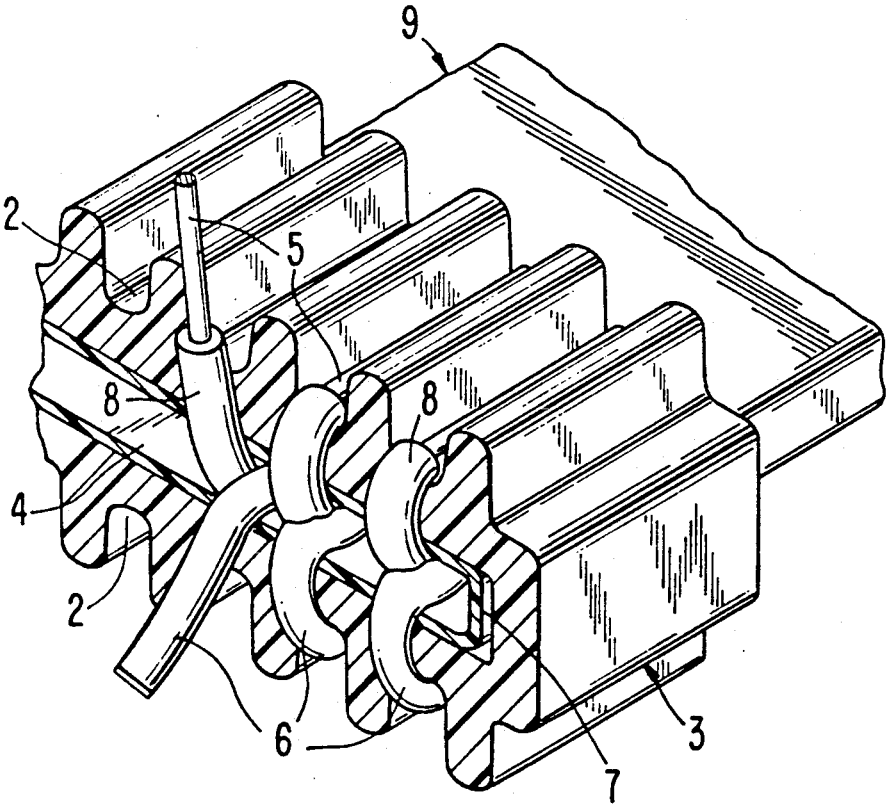
FIG. 5 shows in a perspective cross-sectional view a guide with a ribbon coaxial signal cable residing in the center slot of the guide, the cable jacket removed to expose the individual coaxial cables, the shielding of each cable unwound from around its cable insulation, rolled into wire-like rolls and folded into the grooves along the bottom of the guide, the insulation removed from the center conductors and the center conductors folded into the grooves along the top of the guide.
Figure 2:
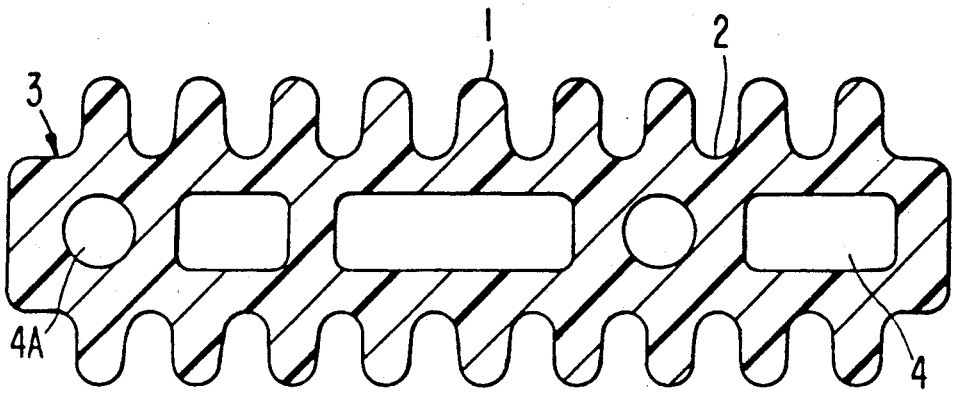
FIG. 2 shows in a cross-sectional view an alternative form of guide of the invention.

FIGS. 1, 2 and 5 describe the guide 3 of the invention which is shaped as a bar of insulative polymer, preferably of full density PTFE, although other polymers having suitable equivalent properties or a ceramic bar could be used alternatively. In FIG. 1 slot 4 passes through guide 3 from front to back and grooves 2 are cut into the top and bottom of guide 3 to provide insulative spacers 1 between each two grooves 2. FIG. 2 shows in cross-section an alternative form of guide 3 in which slots 4 and apertures 4A pass through guide 3 from front to back in an arrangement to match the selected round and flat cables being terminated with aid of guide 3. Guide 3 may have spacers 1 and grooves 2 cut into only one side when terminating to a single row connector.

Figure 3:
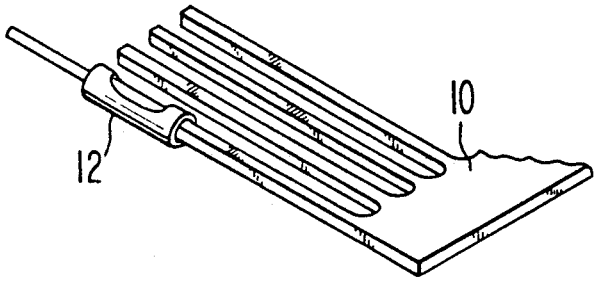
FIG. 3 depicts in a broken perspective view a lead frame of the invention having a male connector pin crimped onto a lead.
Figure 4:
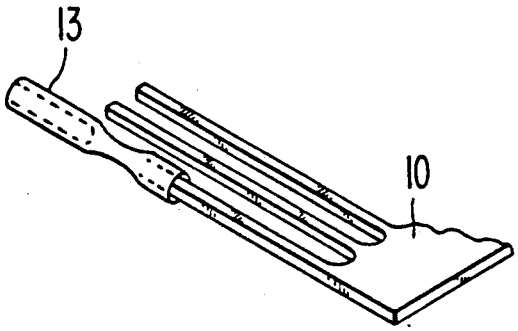
FIG. 4 describes in a broken perspective view a lead frame of the invention having a female connector pin crimped onto a lead.

FIGS. 3 and 4 describe partial perspective views of lead frames 10, the tines or leads of which the connector pins 12 or sockets 13 crimped thereon.

In FIG. 5, it is seen that cable 9, which may be a ribbon cable housing many coaxial cables, has been inserted into slot 4 of guide 3. The cable jacket 7 has been removed from the cable even with the front face of guide 3. Cable shielding 6 has been unwound from around the primary insulation 8 of each coaxial cable and rolled into a wire shape. Each rolled shielding 6 is then folded downwardly into a groove 2 where each shielding roll 6 lies separated from each other shielding roll 6 by spacers 1 between each groove 2.

The primary insulation 8 is removed partially from each conductor 5 and the conductors 5 folded upwardly into grooves 2 between spacers 1 on the top side of guide 3. Shielding rolls 6 and conductors 5 now lie conveniently separated from each other in position for termination to the pins of a connector body.

Figure 6:
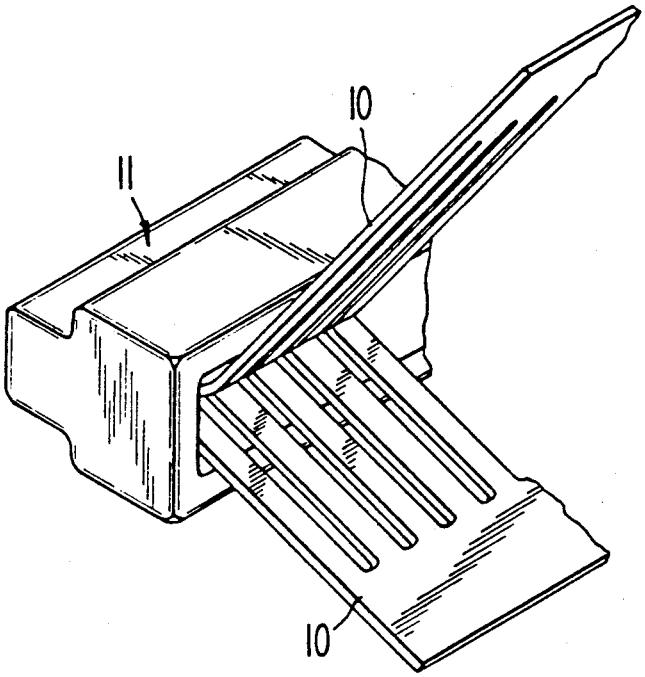
FIG. 6 depicts in a perspective view a connector body with two lead frames spread apart ready to align with the guide.
Figure 7:
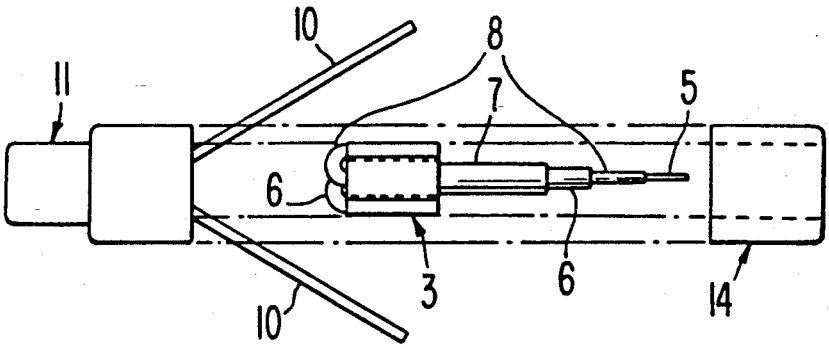
FIG. 7 is an exploded side view of an assembly of the invention with connector, spread pair of lead frames, guide with attached cable, and backshell.

Such a connector body 11 is shown in FIG. 6 with two lead frames 10 attached to connector pins 12 or sockets 13 and inserted in connector body 11.

in FIG. 7, connector body 11 with lead frames 10 is shown in a side view with the guide 3 and attached cable 7 properly aligned for termination of conductors 5 to lead frames 10 (top row) and shielding 6 aligned for termination to lead frames 10 (bottom row), with backshell 14 in position on the cable to be placed over guide 3 abutting connector body 11 in the final step of termination.

Figure 8:
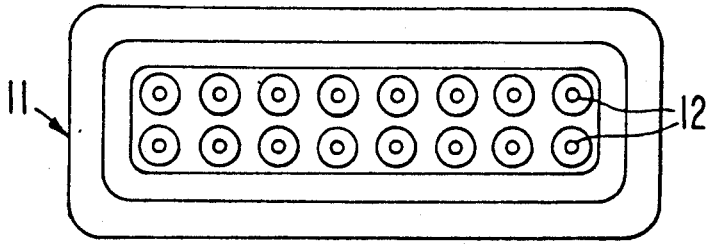
FIG. 8 shows a front face view of a connector body.

A typical 16-pin connector 11 is shown in FIG. 8, with pins 12 facing out the front of connector 11.

Figure 9:
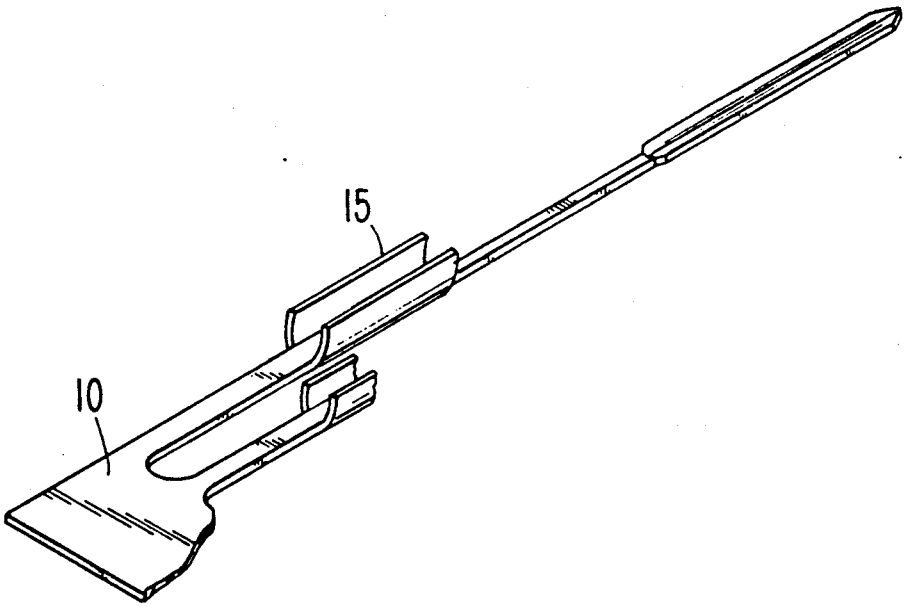
FIG. 9 describes a perspective view of an alternative form of pin useful in the invention, having a crimp barrel formed onto each lead.

FIG. 9 displays a perspective view of an alternative form of lead frame 10 having a crimping barrel 15 formed onto each lead for crimping onto conductor 5 in groove 2 of guide 3.

Figure 10:
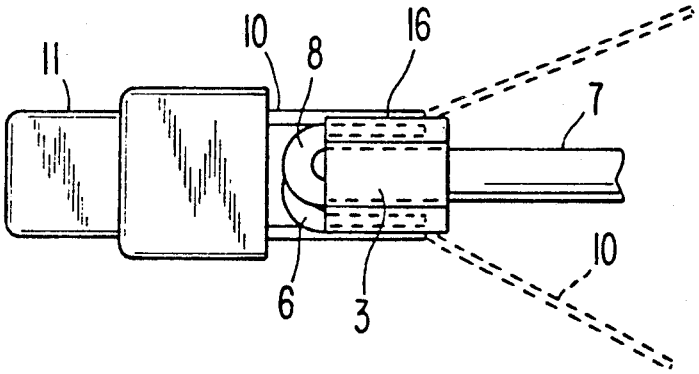
FIG. 10 describes in an exploded side view the connector, the guide with shield rolls and center conductors of the cable affixed by solder or crimping to the pins, and the unneeded portions of the lead frames removed.

FIG. 10 describes the connector 11 in a side view with lead frames 10 affixed to the conductors 5 and shields 6 in soldered or crimped joints 16 in the grooves 2 of guide 2 with the excess lead frames clipped off as shown by the dotted lines. Conductors 5 and lead frames 10 or barrels 15 may be pretinned to form a reflowed solder bond between the pins and conductors 5 and/or shields 6, under heating. Solder preforms may be used instead of tinned leads.

Figure 11:
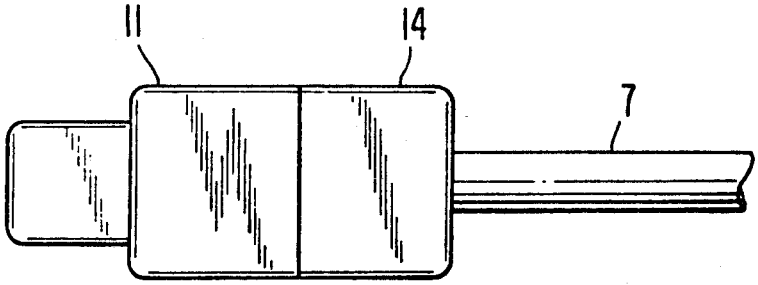
FIG. 11 shows a side view of the assembly of the invention after filling with cured, hardenable insulative fill and closure of the backshell to the body of the connector.

After completion of the joining of the cable and connector leads, backshell 14 is now slid forward on the cable so that it will cover guide 3 and mate to body 11 as shown in FIG. 11. The volume at the back of body 11, around guide 3 and the joints 16, and inside the backshell 14 is filled with a liquid insulating polymer material, such as epoxy resin, which can be easily cured and hardened around the components to complete the assembly of the invention.

Referring again to FIGS. 1 and 2 and 5, two shields 6 can be terminated together in one slot 2 if the connector has fewer positions available than needed.

The guide, connector, and assembly of the invention may be used to terminate discrete wires, pairs of insulated wires, coaxial cables both singly and in the form of ribbon or flat cables, round cables containing a multiplicity of cables and wires, and hybrid cables containing pairs of single wires and coaxial cables mixed in the cable. The slot 4 in guide 3 could be replaced by a series of properly sized individual apertures to fit a particular cable. One or more spacers 1 could be removed from guide 3 to accommodate a large conductor 5 or a conductor 5 may be soldered or crimped to two pins. Cables having flat conductors 5 can be terminated by the guide 3, connector, and the assembly of the invention.

Metal connectors in the form of two halves may be used instead of plastic forms of body 11 and backshell 14 if insulation is placed around the conductors, pins and joints. The body 11 may be used with either female or male forms of pins crimped or soldered onto lead frames 10. Conductors 5 and shielding 6 may be placed in alternate grooves on the same side of guide 3 if desired to yield an assembly having alternate signal and shield pin outlets on the mating face of body 11.

The guide and assembly allow termination of 40 gauge or larger or smaller conductors to pins on 0.025 inch centers or larger or smaller. Tight impedance control is achieved by bringing the cable shields very close to the connector pins for termination.

Bringing the cable jacket 7 through the slot 4 in the guide 3 allows a maximum of bond area for the hardenable insulative polymer resin to provide good strain relief. Folding the conductors and shields upwardly and downwardly around the guide in a uniform manner results in good load sharing among the components of the cable for a stronger more reliable assembly.

The guide and the termination procedures used with it advantageously lead to less bending, handling, flexing, and stretching during the termination and assembly processes, thus lowering the possibility for damage during those processes.

Guide 3 may be injection molded from a suitable thermoplastic insulative polymer as well as laser or otherwise cut from PTFE sheeting or formed of a ceramic material. The size, shape and insulative properties are important to the usefulness of the guide 3.

The figures are drawn much larger than scale to show the details of the invention, the assembly typically being as small or smaller in actual size than one-half inch wide and one-eighth inch in thickness.

We claim:

1. An electrical connector assembly comprising:

(a) a connector body, including one or more closely spaced rows of closely spaced connector pins attached to lead frames affixed therein, said lead frames extending from the back face of said body;

(b) a termination guide, having a slot therethrough for housing electrical signal cables, a series of alternating spaced apart grooves and spacers being formed into one or both the upper and lower surfaces of said guide paralleling said slot for housing bared end portions of conductors and shielding of;

(c) one or more electrical signal cables passing through said guide, folding over the end of said guide, opposite that of the entrance of said cable, into said grooves between said spacers and being terminated to said pins;

(d) a connector backshell fitting over said lead frames and said guide against said connector body to complete said connector assembly; and (e) a quantity of hardenable, curable liquid insulative resin filling said backshell, surrounding said guide, said terminated conductor and shielding ends, and said lead frames.

2. An assembly of claim 1 wherein said electrical signal cables are selected from the group consisting essentially of insulated wires, uninsulated wires, pairs of insulated wires, coaxial cables, ribbon coaxial cables, ribbon cables, shielded ribbon cables, and round cables.

3. An assembly of claims 1 or 2 wherein said guide comprises polytetrafluoroethylene.

4. An assembly of claim 1 wherein said guide is selected from the group consisting essentially of insulative thermoplastic polymer and ceramic material.

5. An assembly of claim 1 wherein said liquid insulative resin comprises an epoxy resin.

6. An assembly of claim 1 wherein said pins are attached to said lead frames by crimping, soldering, or are integrally formed on the leads of said lead frame.

7. An assembly of claim 1 wherein a crimp barrel is integrally formed on at least one lead of a said lead frame.

8. A termination guide for terminating electric cables and wires comprising:

(a) an elongated bar of insulating polymer, having a slot therethrough for passage through and retention by said bar of one or more electric cables, said cables comprising conductors, insulation, and shielding; and (b) a series of spaced apart alternating grooves and spacers formed into one or more surfaces of said bar paralleling said slot for housing bared ends of conductors and shielding of said electric cables to be terminated to pins of a connector.

9. A guide of claim 8 wherein said electric cables are selected from the group consisting essentially of insulated wires, uninsulated wires, pairs of insulated wires, coaxial cables, ribbon cables, ribbon coaxial cables, shielded ribbon cables, and round cables.

10. A guide of claim 8 wherein said insulating polymer comprises polytetrafluoroethylene.

11. A guide of claims 8, 9 or 10 comprising a laser-cut bar of insulative polymer.

12. A guide of claim 8 comprising injection molded thermoplastic polymer.

13. A guide of claim 8 comprising a ceramic material.

14. A termination guide for terminating electric cables and wires comprising:

(a) an elongated bar of insulating polymer, having a combination of slots and apertures therethrough for passage through and retention by said bar of a multiplicity of electric cables sized to fit said slots and apertures, said cables comprising conductors, insulation, and shielding; and (b) a series of spaced apart alternating grooves and spacers formed into one or more surfaces of said bar paralleling said slots and apertures for housing bared ends of conductors and shielding of said electric cable to be terminated to pins of a connector.

15. A guide of claim 14 wherein said electric cables are selected from the group consisting essentially of insulated wires, uninsulated wires, pairs of insulated wires, coaxial cables, ribbon cables, ribbon coaxial cables, shielded ribbon cables, and round cables.

16. A guide of claim 14 wherein said insulating polymer comprises polytetrafluoroethylene.

17. A guide of claim 14, 15, or 16 comprising a laser-cut bar of insulative polymer.

18. A guide of claim 14 comprising injection molded thermoplastic polymer.

19. A guide of claim 14 comprising a ceramic material.

20. An assembly of claim 1 including a termination guide comprising:

(a) an elongated bar of insulating polymer, having a combination of slots and apertures therethrough for passage through and retention by said bar of a multiplicity of electric cables sized to fit said slots and apertures, said cables comprising conductors, insulation and shielding; and (b) a series of spaced apart alternating grooves and spacers formed into one or more surfaces of said bar paralleling said slots and apertures for housing bared ends of conductors and shielding of said electric cable to be terminated to the pins of the cable.

* * * * *